United States Patent [19]

Rogers et al.

[11] Patent Number: 4,917,217

[45] Date of Patent: Apr. 17, 1990

[54] PORTABLE FOLDING STAGING

[75] Inventors: Orley D. Rogers, Farwell; Kenneth E. Staten, Clare, both of Mich.

[73] Assignee: Stageright Corporation, Clare, Mich.

[21] Appl. No.: 299,345

[22] Filed: Jan. 23, 1989

[51] Int. Cl.[4] ..... E04G 1/34; E04H 3/10

[52] U.S. Cl. ..... 182/152; 182/178; 52/7

[58] Field of Search ..... 182/152, 178, 179; 52/646, 8, 143, 6, 7; 108/112

[56] References Cited

U.S. PATENT DOCUMENTS

| | | | |
|---|---|---|---|
| 2,669,117 | 2/1954 | Fuhrmann | 182/152 |
| 2,978,754 | 4/1961 | Wilson | 108/112 |
| 3,199,518 | 8/1965 | Glidewell | 182/152 |
| 3,212,605 | 10/1965 | Dickerson | 182/152 |
| 3,354,596 | 11/1967 | Schafer | 182/152 |
| 4,638,604 | 1/1987 | Rogers | 52/6 |
| 4,779,542 | 10/1988 | Staten | 108/112 |

*Primary Examiner*—Reinaldo P. Machado
*Attorney, Agent, or Firm*—Barnes, Kisselle, Raisch, Choate, Whittemore & Hulbert

[57] ABSTRACT

A stage panel support assembly including four corner stanchions or posts permanently cross braced in one transverse direction and connected in a longitudinal direction by double jointed arms centrally pivoted at an apex on a base frame upright. A cross brace joins respective arms at points spaced from the apex. The corner stanchions are movable from a storage position above the base frame to the operative position spaced from the base and in a vertical position relative to a supporting surface. Projections at the top of the stanchions cooperate with removable horizontal panels which further stabilize the structure in operative position.

4 Claims, 2 Drawing Sheets

PORTABLE FOLDING STAGING

FIELD OF THE INVENTION

Folding and portable support apparatus for stage panels used in temporary staging arrays.

BACKGROUND OF THE INVENTION

Staging structures are illustrated in U.S. Pat. Nos. 4,638,604 (1987) and 4,779,542 (1988) where stage support panels are disposed horizontally in end-to-end and side-by-side positioning to provide a stage system for the presentation of drama events, choral concerts, orchestras and other public showings where a temporary stage is needed. These systems are used in concert halls to enlarge existing stage installations and in auditoriums or gymnasiums where no permanent stage is present.

It is desirable that the temporary staging be portable and collapsible in order that it may be moved to storage or trucked away to restore any particular hall to its normal area and function.

The above-referenced U.S. Pat. No. 4,779,542 (1988) discloses a fold and roll away stage panel structure in which the panels are included on the support, and these panels fold up for storage and down for use. It is an object of the present invention to provide a multiple stanchion structure with support posts positionable at four corners of a square or rectangular area. A roll away base is provided centrally of the structure and collapsible brace and locator arms are mounted on a transverse base upright frame to move the corner posts to a designated position and to support the posts in a retracted position above the base.

Thus, the object of the invention is to provide a fold and roll away structure which is extremely stable in a working position and compact and readily movable in a storage position. This structure is easily operated to its respective function by inexperienced relatively untrained persons and readily moved when collapsed. In addition, it provides a safe structure which can be relied upon to support the weight of persons or equipment or both when subject to the usual forces normally applied to a staging platform.

The objects of the invention are achieved by an assembly including four corner stanchions or posts permanently cross braced in one transverse direction and connected in a longitudinal direction by double jointed arms centrally pivoted at an apex on a base frame upright. A cross brace joins respective arms at points spaced from the apex. The corner stanchions are movable from a storage position above the base frame to the operative position spaced from the base and in a vertical position relative to a supporting surface. Projections at the top of the stanchions cooperate with removable horizontal panels which further stabilize the structure in operative position.

Other objects and features of the invention will be apparent in the following specification and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

Detailed Description of the Invention and the Manner and Process of Using It

Figure 1:
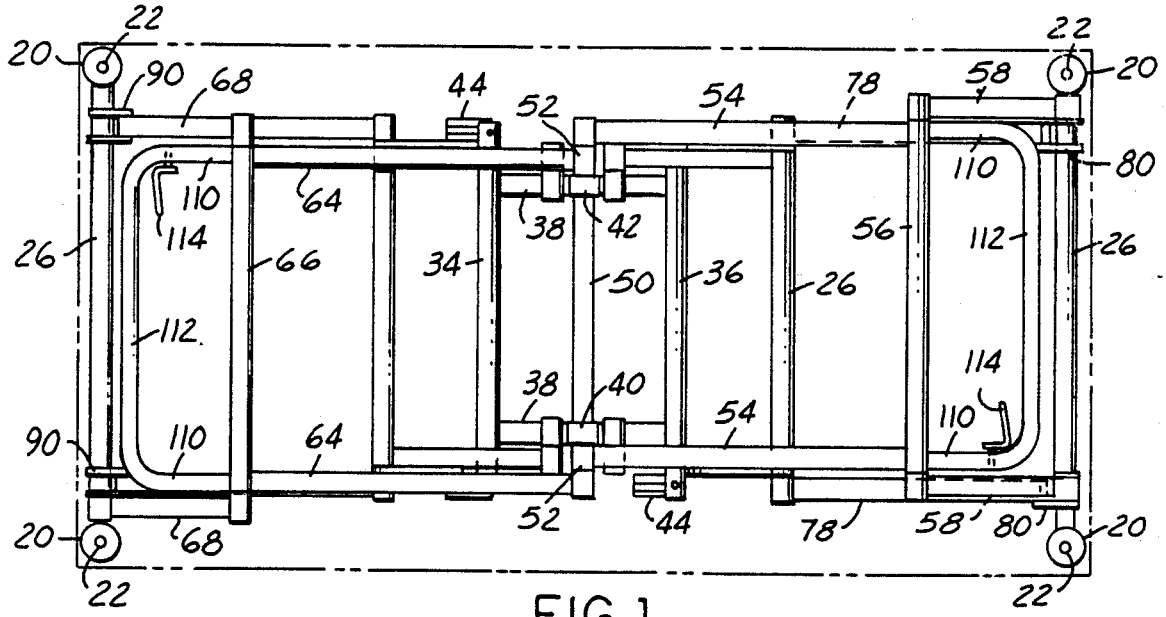
FIG. 1, a top view of the staging structure in an operative position.
Figure 2:
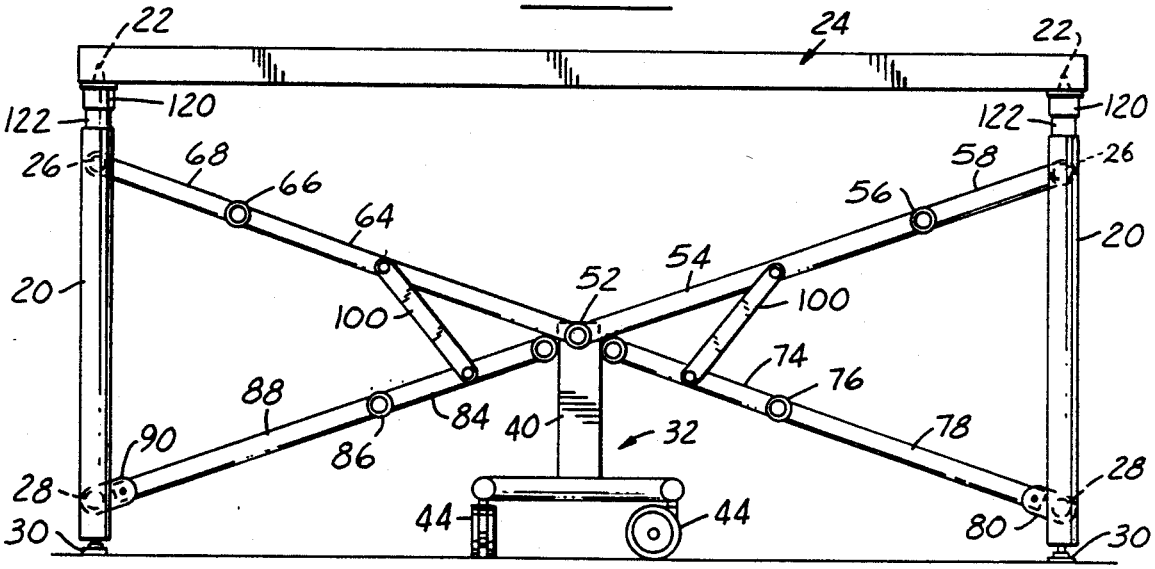
FIG. 2, a side view of the structure as viewed in FIG. 1.
Figure 3:
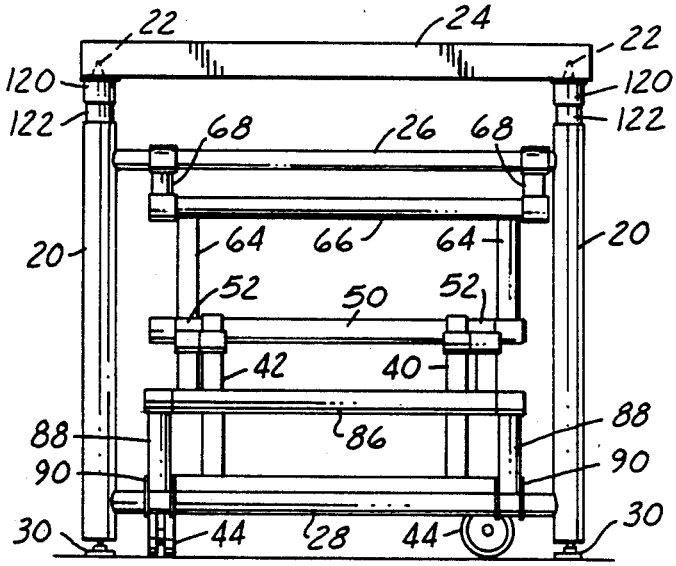
FIG. 3, an end view of the staging structure.

With reference to the drawings, in FIGS. 1, 2 and 3, four tubular stanchions or corner posts 20 each have a small upright projection 22. These projections are received in recesses in the bottom surface at the corners of a stage support panel 24 as shown in FIGS. 2 and 3. The opposed stanchions at each end of a coordinated assembly are connected by upper and lower horizontal cross tubes 26 and 28 rigidly joined to the stanchions by suitable means such as welding. Leveler pads 30 are installed at the lower end of the stanchions.

A rectangular base frame mount 32 is formed of two parallel cross tubes 34 and 36 connected by transverse tubes 38 each of which supports upright bars 40 and 42 respectively. Caster wheels 44 are mounted at the corners of the base frame. These can be arranged to be locked in cross-positions as shown in FIG. 2, if desired, to insure stability.

Figure 4:
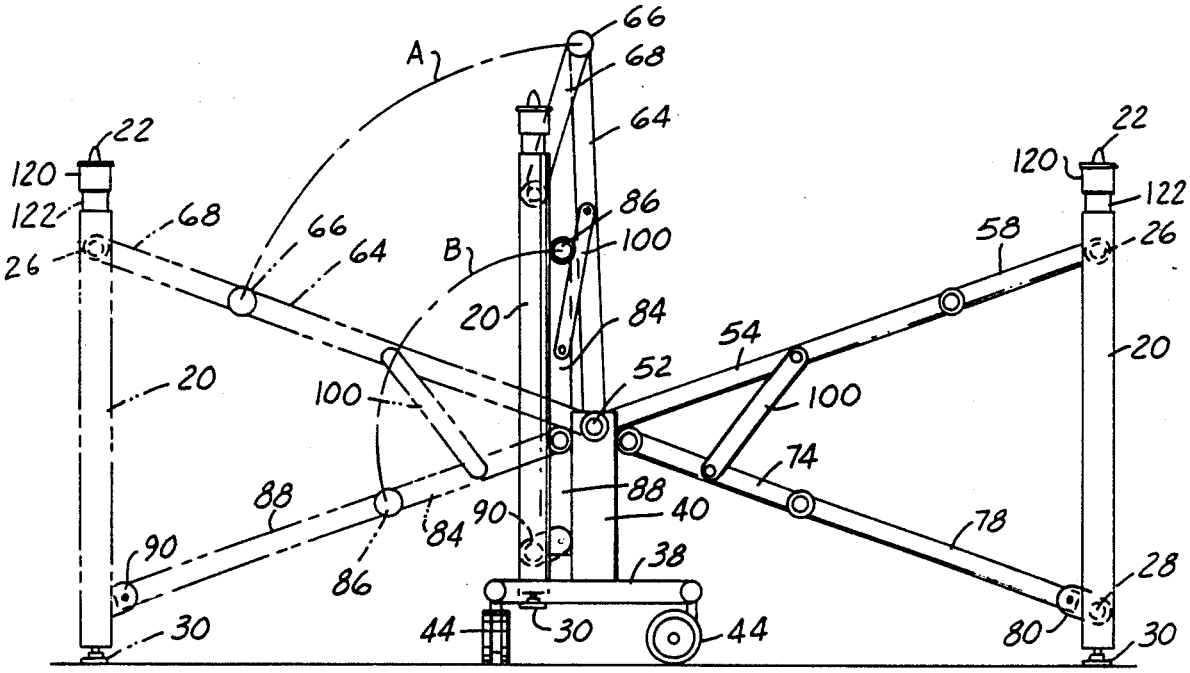
FIG. 4, a view similar to FIG. 2 showing one side in open position, and another side shown dotted in open position and in solid lines in a collapsed storage position.

Each end frame with the two parallel stanchions is connected to the base frame in a manner be moved from the operative position shown in FIGS. 1, 2 and 3 to a folded or collapsed position above the base mount 32 as shown in the solid lines at the left hand side of FIG. 4.

The structure which accomplishes these two positions includes first a cross tube 50 extending between and through uprights 40, 42 to project at extensions 52. Pivotally associated with extensions 52 are right and left collapsible link frames formed at the top right by upper inner brace links 54, cross tube 56, and shorter upper outer brace links 58 pivotally connected to cross tube 56 at one end and to the top end frame cross tube 26 at the other end. At the top left, the link frames are formed of links 64 originating at extensions 52 and pivotally connected to a cross tube 66 which in turn is connected to frame cross tube 28 by shorter links 68. In each case brace links and cross tubes can be solid bars or hollow tubes which have structural rigidity.

It will be noted that the upper brace links 54, 58 and 64, 68 are offset laterally from each other.

The lower link frames are also formed of longer and shorter links. At the lower right, shorter inner brace links 74 are pivotally connected to the sides of uprights 40, 42 and then with cross link 76. Longer outer brace links 78 pivotally connect cross link 76 with lower cross tube 28 through a very short pivot brace spacer link 80. At the lower left, shorter inner brace links 84, connected to the left sides of upright 40, 42, join pivotally to cross link 86 and these in turn connect to longer lower outer brace links 88. Very short pivot brace spacer links 90 connect brace links 88 to lower cross tube 28. Links 80 and 90 can be made of flat plates with suitable pivot connections.

Coordinator links or kick braces 100 assist in the control of the collapsing and opening movement of the support frames. The very short pivot braces 80 and 90 are provided to position the stanchions in parallel positions in the storage position above the base frame.

FIG. 4 is similar to FIG. 1 with the exception that the left side of the assembly is shown in extended position in dot-dash lines and in folded position above the roll away base frame in solid lines.

Arcuate line A shows the path of travel of cross tube 66 and arcuate line B shows the path of travel of cross tube 86. In the collapsing motion, the left-hand end frame including the stanchions 20 is elevated to a position above the base frame and totally supported on the frame. The longer brace links 64 and 88 are disposed in vertical position parallel to the stanchions, and the short brace links 84, being spaced outwardly from links 88, positions adjacent links 88. Shorter brace links 68 and the coordinator link 100 cooperate in lifting the end stanchion frame to the storage position.

When both end assemblies are moved in and up to the folded position, the entire structure is supported on the base and may be readily moved to a storage position or to a truck for transport.

In FIG. 1, each set of upper inner braces 54 and 64 are extended at 110 in the area within the shorter upper outer braces 58 and 68 in parallel runs connected by a cross run 112. To avoid complexity, these elements are not shown in FIGS. 2, 3 and 4. These cross runs may have pivoted latch members 114 which can engage adjacent members to hold the folded assembly in locked position.

Upon setting up the panel supports, the end frames and braces are extended as shown in FIG. 1 and the panel 24 seated on the post projections 22. Upon dismantling, the panel must be removed and the folding achieved as described. If more vertical adjustment is desired, the post caps 120 can be mounted on inner leg tubes 122 which can have an adjustable telescoping relation with the outer leg stanchions 20.

What is claimed is:

1. A stage panel support for portable staging comprising:

(a) a relatively narrow base frame, (b) roll away casters on said frame, (c) four vertical stanchions for supporting four corners of a square or rectangular stage panel, and (d) a plurality of collapsible braces mounted at one end on said base frame and at the other end to said stanchions to move said stanchions from a storage position above said base frame to a support position spaced from said base frame to engage corners of said stage panel, said base frame comprising a horizontal frame, and spaced uprights at each end of said frame, (e) said collapsible braces including upper and lower braces on each side of said base frame secured to an upright of said base frame at a localized pivot area above said base frame and secured to said stanchions at upper and lower spaced pivot points adjacent the top end and the lower end of said stanchions, (f) said collapsible braces including collapsible upper braces with a long brace pivoted to the base upright and a shorter brace pivoted to said upper longer brace and to stanchions at one side adjacent the upper end, and collapsible lower braces with a long brace pivoted to stanchions at the other side adjacent the lower end and a shorter brace pivoted to said lower longer brace and to said base upright, whereby in a support position said upper and lower braces form triangular supports with two diverging sides connected to the stanchions and the apex connected to a base support upright.

2. A stage panel support as defined in claim 1 in which a short spacer link is pivotally interposed between the longer lower braces and the lower end of the stanchions to space the stanchion in a nested position on the base frame.

3. A stage panel support as defined in claim 1 in which a kick brace pivotally connects to the upper longer brace and the shorter lower brace to assist in the collapsing of said braces from a support position to a storage position.

4. A stage panel support for portable staging comprising:

(a) a relatively narrow base frame, (b) roll away casters on said frame, (c) four vertical stanchions for supporting four corners of a square or rectangular stage panel, and (d) a plurality of collapsible braces mounted at one end on said base frame and at the other end to said stanchions to move said stanchions from a storage position above said base frame to a support position spaced from said base frame to engage corners of said stage panel, said base frame comprising a horizontal frame, and single spaced vertical uprights at each end of said frame, (e) said collapsible braces including upper and lower braces on each side of said base frame secured to an upright of said base frame at a localized pivot area above said base frame and secured to said stanchions at upper and lower spaced pivot points adjacent the top end and the lower end of said stanchions, and whereby in a support position said upper and lower braces form triangular supports with two diverging sides connected to the stanchions and the apex connected to a base support upright.

* * * * *